US006126896A

United States Patent [19]

Choi

[11] Patent Number: 6,126,896

[45] Date of Patent: Oct. 3, 2000

[54] METHOD OF PRODUCING TITANIUM CARBIDE (TIC) BASED CERMETS THROUGH REACTION MILLING PROCESS

[75] Inventor: Chul Jin Choi, Changwon-shi, Rep. of Korea

[73] Assignee: Korea Institute of Machinery & Materials, Rep. of Korea

[21] Appl. No.: 09/322,239

[22] Filed: May 28, 1999

[30] Foreign Application Priority Data

Jul. 31, 1998 [KR] Rep. of Korea ..... 98-31301

[51] Int. Cl.[7] ..... B22F 3/12; B22F 1/00

[52] U.S. Cl. ..... 419/32; 419/11; 419/17; 419/55

[58] Field of Search ..... 419/11, 17, 32, 419/55

[56] References Cited

U.S. PATENT DOCUMENTS 4,891,341 1/1990 Cutler et al. ..... 501/89

*Primary Examiner*—Daniel J. Jenkins
*Attorney, Agent, or Firm*—Cooper & Dunham LLP

[57] ABSTRACT

A method of making TiC based cermets through a reaction milling process is disclosed. In the method of this invention, a particle mixture, consisting of 50–95 wt. % Ti-C particles, with Ti particles being mixed with C particles at a weight ratio of 4:1, and 5-50 wt. % Ni particles, is reaction-milled in a Spex mill, thus making TiC based particles. A preform is formed of the TiC based particles and is sintered, thus making a TiC based cermet. The Ni particles of the particle mixture may be substituted with Ni-Mo particles. In addition, the method may further comprise the steps of presintering the preform from the forming step, and intermediate-machining the presintered preform prior to finally sintering the preform, thus machining the preform more precisely. The sintering temperature preferably ranges from 1,300° C. to 1,400° C. In the method of this invention, the TiC particles are made through the reaction milling process, thus reducing the production cost while making the TiC based cermets. The size of TiC particles is very fine, and so the resulting cermets preferably have both a high degree of hardness and a high degree of toughness.

4 Claims, 7 Drawing Sheets

(a) 1200 ℃

(b) 1300 ℃

(c) 1400 ℃

(a) TiC-30wt%Ni ALLOY (b) TiC-25wt%Ni-5wt%Mo ALLOY

METHOD OF PRODUCING TITANIUM CARBIDE (TIC) BASED CERMETS THROUGH REACTION MILLING PROCESS

BACKGROUND OF THE INVENTION

1. Field of the Invention

The present invention relates, in general, to a method of producing cermets, used as a material of cutting tools, die material, etc., and, more particularly, to a method of making titanium carbide (TiC) based cermets using TiC based particles, produced through a reaction milling process, thus making TiC based cermets having both a desirably high degree of hardness and a desirably high degree of toughness, while reducing the production cost of the cermets.

2. Description of the Prior Art

As well known to those skilled in the art, the technical term "cermet" is a composite word of "ceramics" and "metal", and is interpreted as a various combination of metal-ceramic materials in a broad sense. In the field of cutting tools, the term "cermet" somewhat limitedly denotes a carbide based material that is made by mixing, pressing, and sintering metal particles, such as nickel, molybdenum or cobalt particles, with titanium carbide (TiC) or titanium carbonitride (Ti(CN)) ceramic phase powders.

A titanium carbide-nickel-molybdenum cermet or the earliest cermet was proposed and commercially used in Germany in the 1920's. These cermets, made of such titanium carbide-nickel-molybdenum powders, preferably have a high degree of hardness, a high degree of oxidation resistance and a high degree of adhesion resistance, but regrettably have a high degree of brittleness, thus being easily broken. Such cermets are thereby rarely used in a roughing process or an interrupted cutting process.

After the 1920's, TiC-(Ta,W)C-molybdenum-nickel-cobalt cermets, made by mixing, pressing and sintering cobalt in addition to nickel and molybdenum with a second or third carbide in addition to the titanium carbide, have been proposed and used. The cermets, made of the TiC-(Ta, W)C-molybdenum-nickel-cobalt powders, have an improved cutting performance in comparison with the titanium carbide-nickel-molybdenum cermets.

After the 1970's, TiC-TiN cermets or Ti(CN) cermets, having an improved toughness and a high degree of thermal stability, have been proposed and commercially marketed.

FIG. 1*a* is a block diagram showing a conventional process of producing a TiC based cermet. As shown in the drawing, the conventional process of producing the TiC based cermet comprises the steps of primarily mixing metal particles, such as Ni, Co, or Mo particles, with carbide ceramic particles, such as TiC, TaC, or WC particles, while mixing the particles, thus preparing a metal-ceramic particle mixture prior to forming a preform using the metal-ceramic particle mixture. The preform is, thereafter, presintered, intermediate-machined and final-sintered, thus making a desired cermet. In such a TiC based cermet, the hardness and toughness of the cermet is determined by the size of the TiC particles.

However, the TiC based cermet is problematic in that the TiC particles, determining the properties of the resulting cermet, are very expensive and the cost of the TiC particles is further increased as the size of the TiC particles is reduced. Therefore, TiC based cermet tools, having a high degree of hardness and a high degree of toughness, have to be regrettably made at a high production cost and this restricts the TiC based cermet tools from being more widely used in a cutting process.

SUMMARY OF THE INVENTION

Accordingly, the present invention has been made keeping in mind the above problems occurring in the prior art, and an object of the present invention is to provide a method of making TiC based cermets using micro TiC based particles, in which the TiC based particles are produced by milling the relative cheap Ti particles and carbon particles through a reaction milling process, which thus preferably reduces the production cost of the TiC based cermets since it uses the cheap Ti and carbon particles in place of typical expensive TiC particles, and which easily produces desired TiC based cermets having both a desirably high degree of hardness and a desirably high degree of toughness since it uses the TiC based particles having a fine size.

In order to accomplish the above object, the present invention provides a method of producing TiC based cermets, comprising the steps of: reaction-milling a particle mixture, consisting of 50–95 wt. % Ti-C particles with Ti particles being mixed with C particles at a weight ratio of 4:1 and 5–50 wt. % Ni particles, in a Spex mill, thus making TiC based particles; forming a preform using the TiC based particles; and sintering the preform, thus making a TiC based cermet.

In the present invention, the above method of producing the TiC based cermets may be performed while substituting the Ni particles of the particle mixture with Ni-Mo particles. In addition, the method may further comprise the steps of; presintering the preform from the forming step; and intermediate-machining the presintered preform prior to finally sintering the preform, thus machining the preform more precisely. In the above method, the sintering temperature preferably ranges from 1,300° C. to 1,400° C.

In the above method, the particle mixture, consisting of the Ti-C particles and the Ni or Ni-Mo particles, is reacted in a reaction mill or a Spex mill, thus forming a TiC composite material. In such a case, the amount of the Ti-C particles, with Ti particles being mixed with C particles at a weight ratio of 4:1, has to be set to 50–95 wt. % based on the total weight of the particle mixture. If the amount of the Ti-C particles in the mixture is less than 50 wt. %, the resulting TiC based cermet fails to have a desired hardness. On the other hand, when the amount of the Ti-C particles in the mixture is more than 95 wt. %, the resulting TiC based cermet fails to have a desired ductility even though it has a desired hardness, thus being easily broken.

In addition, the amount of the Ni or Ni-Mo particles, used as a binder in the TiC composite material produced from the reaction milling process, has to be set to 5–50 wt. % based on the total weight of the particle mixture. If the amount of the Ni or Ni-Mo particles in the mixture is less than 5 wt. %, the resulting TiC based cermet has a high degree of brittleness, thus being easily broken even though the cermet preferably has a high degree of hardness. On the other hand, when the amount of the Ni or Ni-Mo particles in the mixture is more than 50 wt. %, the resulting TiC based cermet regrettably has an exceedingly high degree of ductility.

In the above method, the sintering temperature for the preform has to range from 1,300° C. to 1400° C. If the sintering temperature is lower than 1,300° C., the resulting cermet may have a porous structure. On the other hand, when the sintering temperature is higher than 1,400° C., the size of TiC is exceedingly increased. In such a case, it is almost impossible to give a desired toughness or a desired hardness to the resulting cermet.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1A:
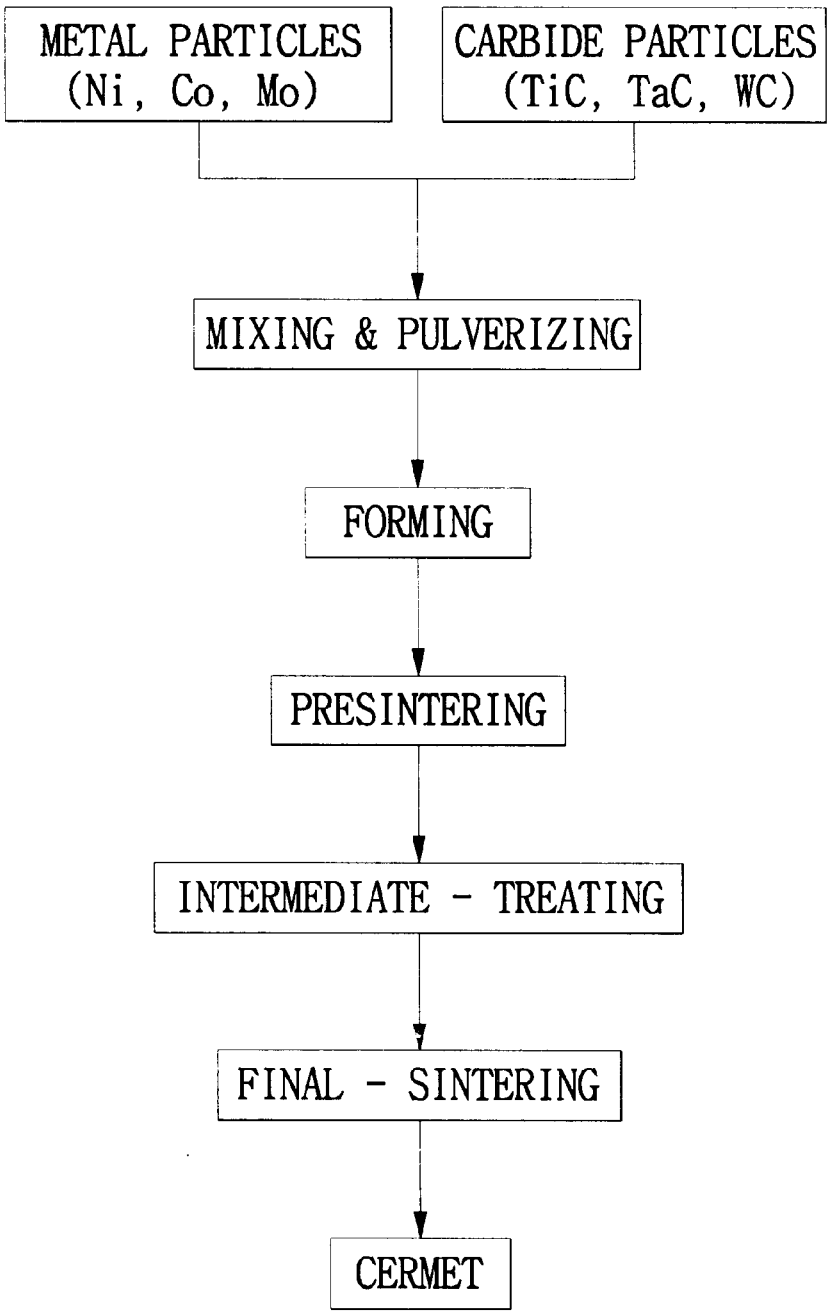
FIG.1a(PRIOR ART)
FIG. 1*a* is a block diagram showing a conventional process of producing a TiC based cermet.
Figure 1B:
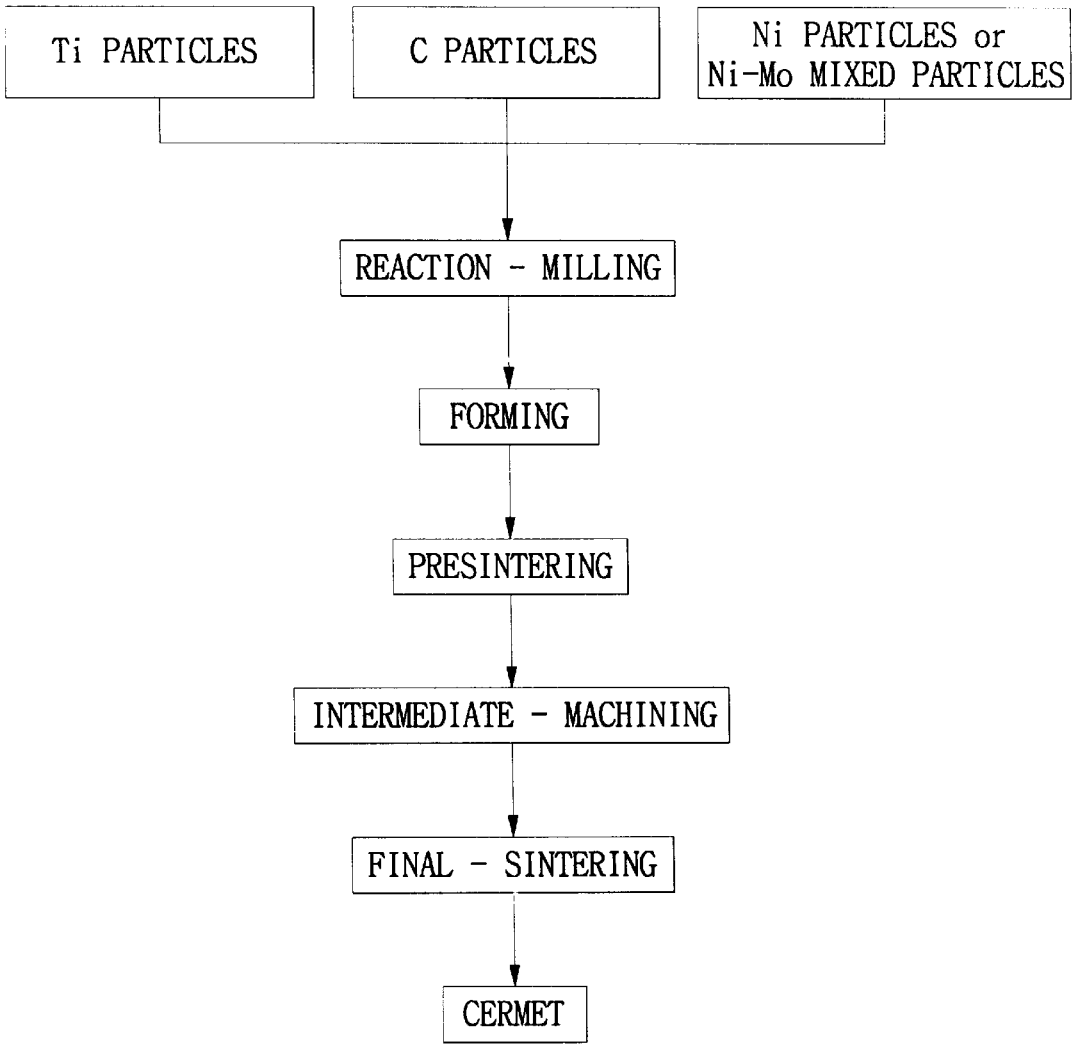
FIG. 1*b* is a block diagram showing a process of producing a TiC based cermet in accordance with the preferred embodiment of the present invention.
Figure 2:
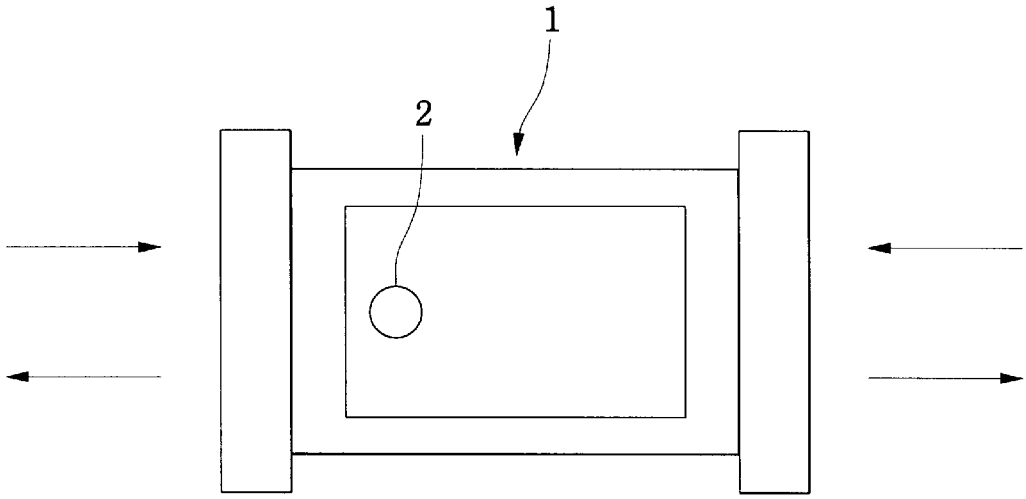
FIG. 2 is a view of a Spex mill used in a reaction milling process of the invention.

The present invention provides a method of producing TiC based cermets using TiC based particles. The above method comprises a reaction milling process wherein metal and ceramic particles are ball-milled with high mechanical energy, thus being reacted with each other during the milling process and thereby making TiC based alloy particles having desired properties and structure, both being remarkably different from those of raw particles for the TiC based alloy. The reaction milling process of this invention is performed using a Spex mill 1 of FIG. 2. In the reaction milling process, a metal ball 2 and raw particles are filled in the Spex mill 1. Thereafter, the Spex mill 1 is vibrated in three axial directions, thus reacting the raw particles with each other due to an impact energy applied from the metal ball 2.

In such a case, it is preferable to coat the interior wall of the Spex mill 1 with a pure titanium, thus almost completely preventing impurities from being added to the raw particles from the mill 1.

A better understanding of the present invention may be obtained through the following examples which are set forth to illustrate, but are not to be construed as the limit of the present invention.

EXAMPLE 1

A particle mixture, consisting of 56 wt. % Ti particles, 14 wt. % C particles, and 30 wt. % Ni particles, was filled in a Spex mill 1 and was subjected to a reaction milling process. In such a case, the weight ratio of the metal ball 2 to the particle mixture, both being filled in the mill 1, was set to 20:1. During the above reaction milling process, the Spex mill 1 was vibrated at a frequency of about 1,600 cycles/min, with a vertical amplitude of about 2.25 inches and a horizontal amplitude of about 1 inch.

In order to observe a change in the phase of the particle mixture during the reaction milling process, a small amount of particles were repeatedly picked up from the mill 1 at regular intervals during the process, and were subjected to an X-ray diffraction analysis. The spectra of the X-ray diffraction analysis for TiC-30 wt. % Ni alloy, produced through the above reaction milling process, are shown in FIG. 3.

Figure 3:
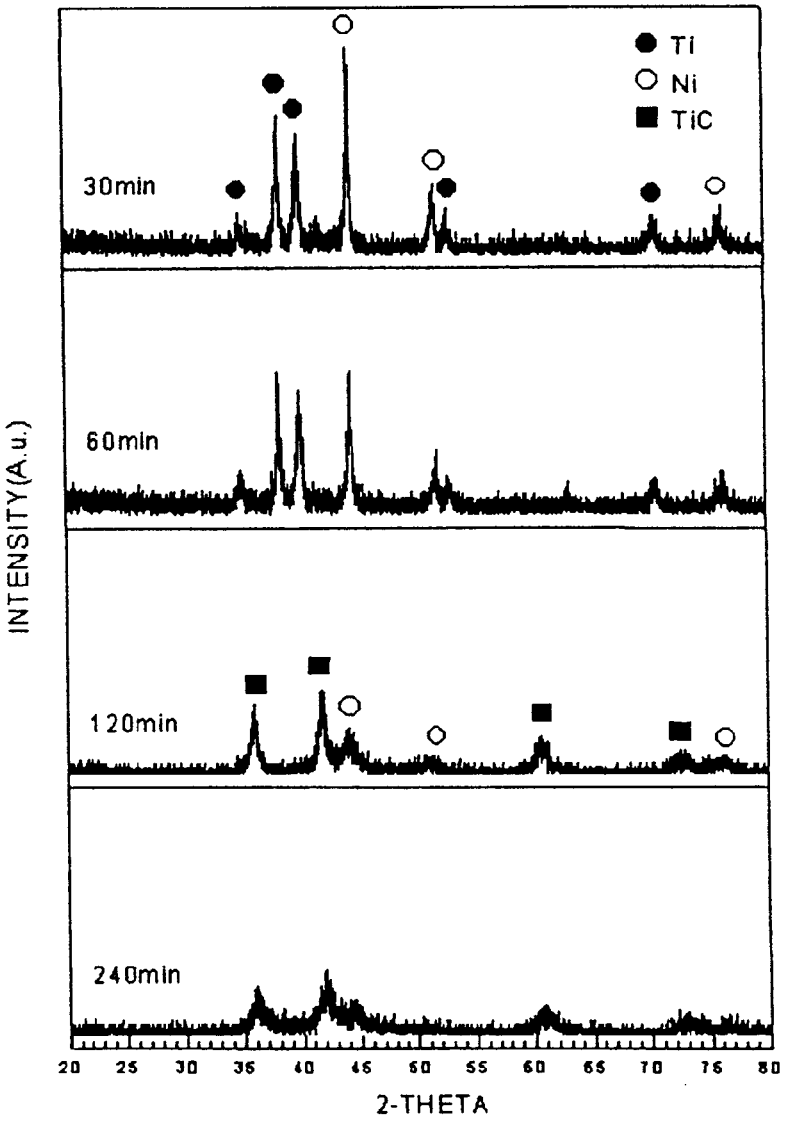
FIG. 3 is a graph, showing the spectra of an X-ray diffraction analysis for TiC-30 wt. % Ni alloy produced through the reaction milling process of this invention.

As shown in FIG. 3, peaks, indicative of the characteristics of Ti and Ni particles, are detected at the diffraction spectrum after the raw particles have been reaction-milled for 30 minutes or 60 minutes. However, after the raw particles have been reaction-milled for 120 minutes, the peaks, indicative of the characteristics of the Ti particles, disappear from the diffraction spectrum, while peaks, indicative of the characteristics of TiC which is not included in the raw particles, are detected at the spectrum.

This means that the Ti particles are reacted with the active carbon particles in the vibrated Spex mill 1, thus forming TiC based particles.

When the reaction milling process is continued for 240 minutes, the spectrum of the X-ray diffraction analysis is similar to that for TiC-30 wt. % Ni alloy produced through the 120 minute process. This means that there is no remarkable difference in the phase of TiC-30 wt. % Ni alloy between the 120 minute process and the 240 minute process.

EXAMPLE 2

The reaction milling process of example 1 was repeated while substituting 30 wt. % Ni particles of the particle mixture with Ni-Mo particles consisting of 25 wt. % Ni particles and 5 wt. % Mo particles.

In order to observe a change in the phase of the particle mixture, consisting of 56 wt. % Ti particles, 14 wt. % C particles, 25 wt. % Ni particles, and 5 wt. % Mo particles, during the reaction milling process, a small amount of particles were repeatedly picked up from the mill 1 at regular intervals during the process, and were subjected to an X-ray diffraction analysis. The spectra of the X-ray diffraction analysis for TiC-25 wt. % Ni-5 wt. % Mo alloy, produced through the above reaction milling process, are shown in the graph of FIG. 4.

Figure 4:
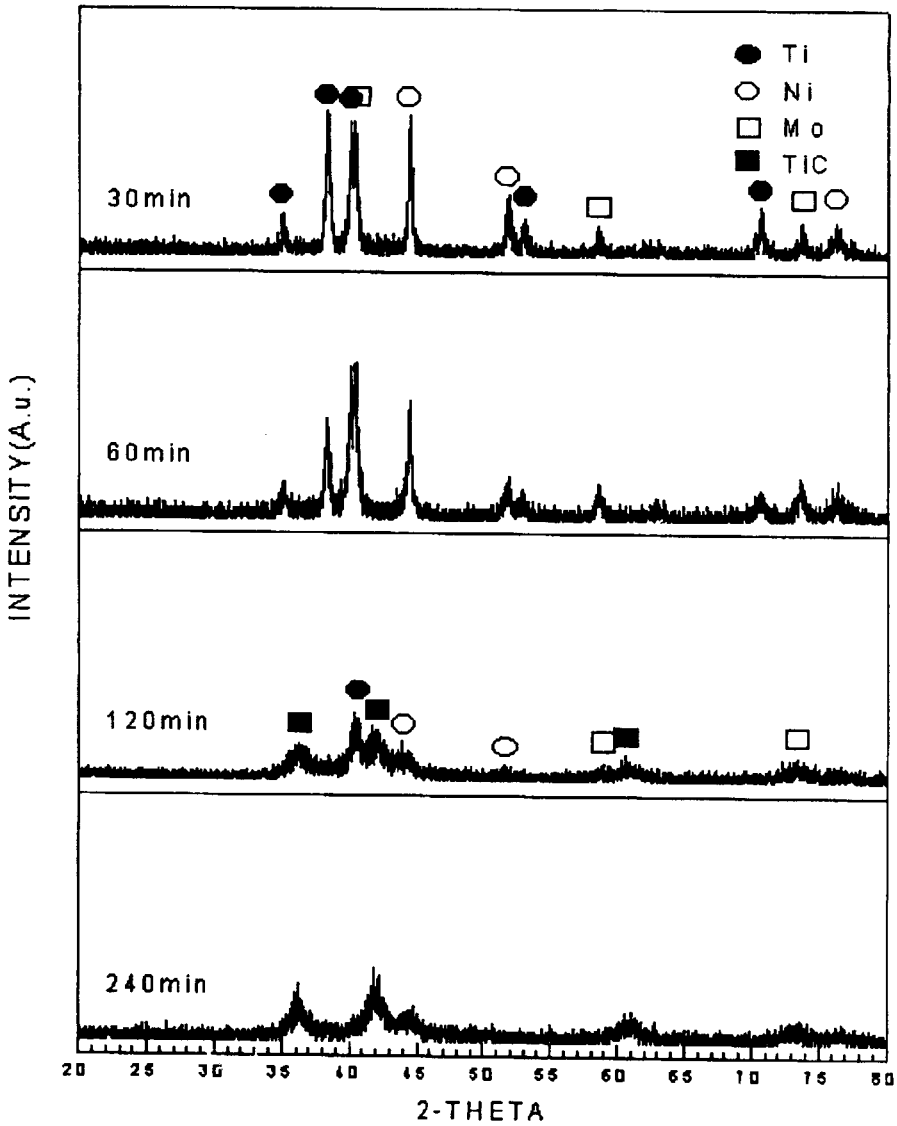
FIG. 4 is a graph, showing the spectra of an X-ray diffraction analysis for TiC-25 wt. % Ni-5 wt. % Mo alloy produced through the reaction milling process of this invention.

As shown in FIG. 4, peaks, indicative of the characteristics of Ti, Ni and Mo particles, are detected at the diffraction spectrum after the raw particles have been reaction-milled for 30 minutes or 60 minutes. However, after the raw particles have been reaction-milled for 120 minutes, the peaks, indicative of the characteristics of Ti particles, disappear from the spectrum, while peaks, indicative of the characteristics of TiC which is not included in the raw particles, are detected at the spectrum.

In accordance with the examples 1 and 2, it is noted that the reactive Ti particles are reacted with the active carbon particles during a reaction milling process using a Spex mill, thus forming TiC based particles.

Thereafter, the TiC based particles, produced from such a reaction milling process, are subjected to a forming process using a cylindrical mold of ϕ11 at a pressure of 3 ton/cm$^2$, thus forming a preform.

In order to determine an appropriate sintering temperature suitable for giving desired properties to the sintered preform, the preform from the forming process is sintered in a vacuum furnace, having a degree of vacuum of lower than $10^{-5}$ torr, at a sintering temperature of 1,200° C., 1,300° C., or 1,400° C. for 2 hours.

Figure 5:
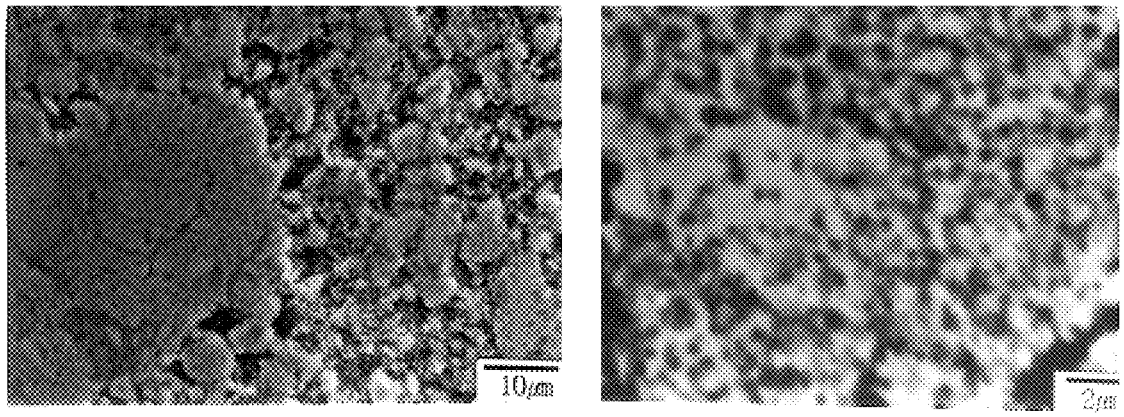
FIGS. 5*a* to 5*c* are scanning electron microphotographs of TiC based cermets, each of which is made by producing TiC-30 wt. % Ni particles through a reaction milling process for 4 hours and forming a preform using the TiC-30 wt. % Ni particles, and sintering the preform at a temperature of 1,200° C., 1,300° C., or 1,400° C.
Figure 5:
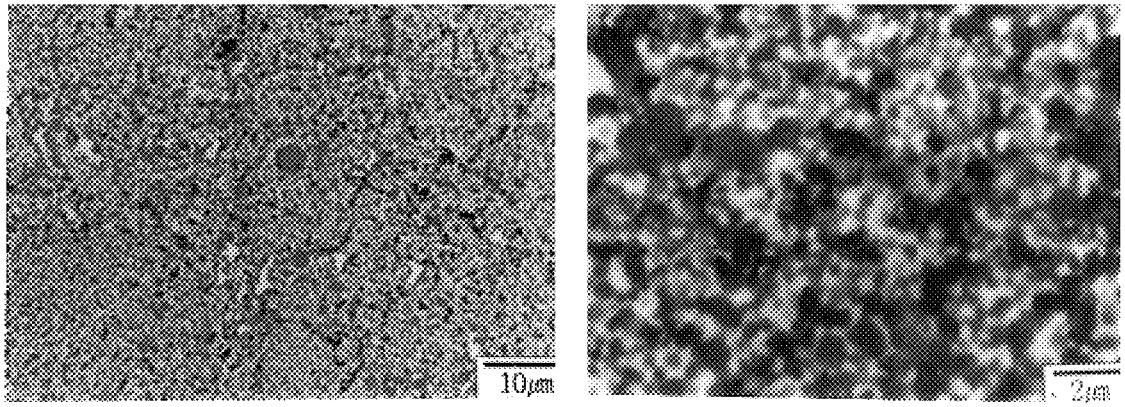
Figure 5:
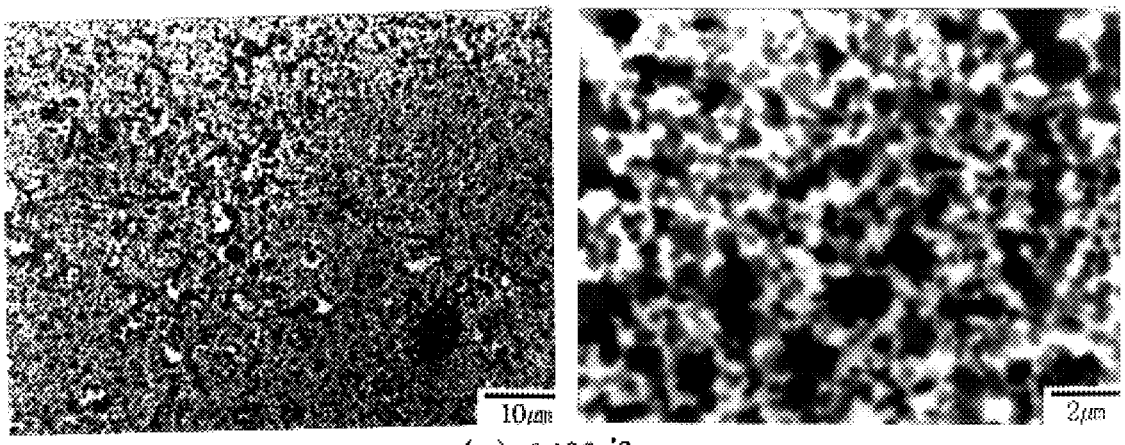

FIGS. 5*a* to 5*c* are scanning electron microphotographs of TiC based cermets, each of which is made by producing TiC-30 wt. % Ni particles through a reaction milling process of a particle mixture, consisting of 56 wt. % Ti, 14 wt. % C and 30 wt. % Ni, for 4 hours and forming a preform using the TiC-30 wt. % Ni particles, and sintering the preform at a temperature of 1,200° C., 1,300° C., or 1,400° C. As shown in the drawings, the preform, sintered at 1,200° C., has a porous structure.

On the other hand, when the preform is sintered at 1,300° C. or 1,400° C., the sintered preform has a dense structure which is almost free from pores. When comparing two preforms, respectively sintered at 1,300° C. and 1,400° C., to each other, the size of TiC after the sintering process is similar in both preforms. However, the preform, sintered at 1,400° C., preferably has a structure with pores having a size smaller than that of the preform sintered at 1,300° C. It is thus determined that the optimum sintering temperature is 1,400° C.

Figure 6:
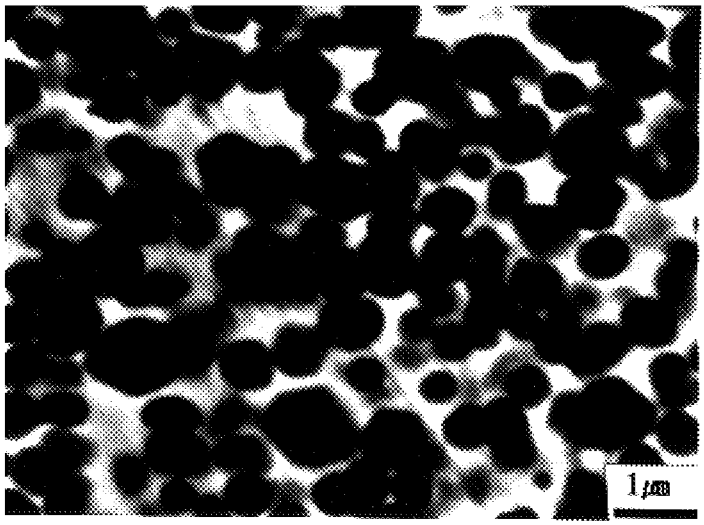
FIGS. 6*a* and 6*b* are scanning electron microphotographs of TiC based cermets, each of which is made by producing TiC-30 wt. % Ni particles or TiC-25 wt. % Ni-5 wt. % Mo particles through a reaction milling process for 4 hours and forming a preform using the TiC-30 wt. % Ni particles or the TiC-25 wt. % Ni-5 wt. % Mo particles, and vacuum-sintering the preform at a temperature of 1,400° C. for 2 hours.
Figure 6:
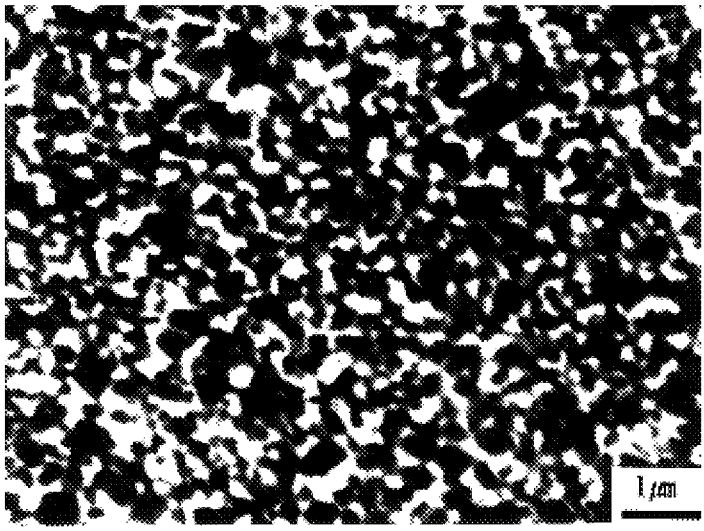

FIGS. 6*a* and 6*b* are scanning electron microphotographs of TiC based cermets, each of which is made by producing TiC-30 wt. % Ni particles or TiC-25 wt. % Ni-5 wt. % Mo particles through a reaction milling process for 4 hours and forming a preform using the TiC-30 wt. % Ni particles or the TiC-25 wt. % Ni-5 wt. % Mo particles, and vacuum-sintering the preform at a temperature of 1,400° C. for 2 hours. In the case of TiC-30 wt. % Ni particles, TiC particles have an average size of 0.2–1.5 μm and have a spherical shape. In the case of TiC-25 wt. % Ni-5 wt. % Mo particles, TiC particles have an average size of 0.05–0.5 μm, thus being finer.

The fine structure of the TiC based cermet of this invention was compared with the structure of conventional TiC based cermets. In the conventional TiC based cermets, the average size of TiC may be changed in accordance with raw particles, but typically ranges from 3 μm to 5 μm. However, in the TiC based cermet of this invention, the average size of TiC ranges from 0.05 μm to 1.5 μm. Therefore, the TiC based cermet of this invention has TiC which is finer than that of the conventional TiC based cermets. The TiC based cermet of this invention thus has remarkably improved properties in comparison with conventional TiC based cermets.

The properties of a TiC based cermet of this invention were compared to that of TiC based cermets according to the prior art, and the results are given in Table 1.

TABLE 1

Comparison of the properties of a TiC based cermet of this invention with those of conventional TiC based cermets

| | TiC size | amount of metal | carbide particles | hardness ($H_RA$) |
|---|---|---|---|---|
| This invention | 0.05–1.5 μm | 30 wt. % | TiC | 90–93 |
| Prior art | 3–5 μm | 10 wt. % | TiC<br>WC<br>TaC<br>VC | 92–93 |

In order to analyze the basic properties of sintered alloys, the sintered alloys were subjected to a room temperature hardness analysis. As shown in Table 1, the sintered alloys have a room temperature hardness of about 90–93 HRA. Such a room temperature hardness is similar to the desired hardness (92–93 HRA) of conventionally marketed cermets. In order to improve the hardness of the conventionally marketed cermets, it is necessary to add WC, TaC, or VC to raw particles of the cermets. In the conventionally marketed cermets, the amount of metal particles (Ni or Mo particles) ranges from 5 wt. % to 10 wt. % based on the total weight of the raw particles. Such an amount of metal particles is lower than that of this invention. In the method of this invention, the raw particles include only TiC as the carbide particles and include 30 wt. % metal particles. Such an amount of metal particles is remarkably more than that of the conventionally marketed cermets. The TiC based cermet of this invention thus has a desirably high degree of hardness. In addition, due to the fine TiC particles, the TiC based cermet of this invention has a desirably high degree of toughness.

As described above, the present invention provides a method of producing TiC based cermets through a reaction milling process. In the method of this invention, the TiC particles for the cermets are made through the reaction milling process, thus reducing the production cost while making the TiC based cermets. In the method of this invention, the size of TiC particles is very fine, and so the resulting cermets preferably have both a high degree of hardness and a high degree of toughness.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of producing TiC based cermets, comprising the steps of:

reaction-milling a particle mixture, consisting of 50–95 wt. % Ti-C particles, with Ti particles being mixed with C particles at a weight ratio of 4:1, and 5–50 wt. % Ni particles, in a Spex mill, thus making TiC based particles;

forming a preform using said TiC based particles; and sintering said preform, thus making a TiC based cermet.

2. The method according to claim 1, wherein other metal particles are substituted for the Ni particles of the particle mixture.

3. The method according to claim 1, further comprising the steps of;

presintering said preform from the forming step; and intermediate-machining the presintered preform prior to finally sintering the preform, thus machining the preform more precisely.

4. The method according to claim 1, wherein the preform is sintered at a temperature of 1,300° C.–1,400° C.

* * * * *